United States Patent [19]

Franek et al.

[11] 4,049,261

[45] Sept. 20, 1977

[54] FEEDER FOR FEEDING SHEETS HAVING A RECESSED PROFILE END EDGE

[75] Inventors: Jozef Tadeusz Franek, Chorleywood; Paul Porucznik, St. Albans, both of England

[73] Assignee: Metal Box Limited, England

[21] Appl. No.: 718,816

[22] Filed: Aug. 30, 1976

[51] Int. Cl.[2] ..... B65H 9/10

[52] U.S. Cl. ..... 271/269; 271/233; 83/278

[58] Field of Search ..... 271/1, 14, 226, 232, 271/233, 267, 269; 198/749; 83/278

[56] References Cited

U.S. PATENT DOCUMENTS

| | | | |
|---|---|---|---|
| 250,304 | 11/1881 | Viellemard | 271/232 |
| 1,065,086 | 6/1913 | Swift, Jr. | 271/1 |
| 2,260,182 | 10/1941 | Knutsen et al. | 83/278 X |
| 2,474,944 | 7/1949 | Henry | 271/233 X |
| 3,116,658 | 1/1964 | Baker | 271/232 X |

*Primary Examiner*—Robert W. Saifer
*Attorney, Agent, or Firm*—Diller, Brown, Ramik & Wight

[57] ABSTRACT

A sheet feeder for feeding sheets accurately in correct orientation, especially to a press for blanking pieces from the sheet, has an intermittent sheet-advancing action in which not only the movement of the sheet, but also its orientation with respect to the path of travel and its transverse position, are determined solely by pusher dogs without any need for side guides. The pusher dogs fit in recesses in the rear edge of the sheet in such a way that the transverse position of the sheet is determined accurately by an abrupt discontinuity of the recess or recesses engaging a pusher dog.

7 Claims, 7 Drawing Figures

FEEDER FOR FEEDING SHEETS HAVING A RECESSED PROFILE END EDGE

FIELD OF THE INVENTION

This invention relates to sheet feeding apparatus for conveying sheets of material along a path in predetermined orientation, each sheet having opposite end edges at least one of which has a recessed profile defined by at least one abrupt discontinuity intermediate between the ends of the edge. Such a sheet will be referred to herein as "a sheet of the kind hereinbefore specified". The invention also relates to methods of conveying such sheets using such apparatus, to apparatus for performing on the sheets manufacturing operations such as the forming of blanks or cup-shaped articles, and to blanks and cup-shaped articles so produced.

BACKGROUND OF THE INVENTION

One typical but non-limiting example of sheets of the above-mentioned kind consists of sheet metal intended to be used for manufacture of stampings, pressings or drawn articles where the initial operation in such manufacture is to form a plurality of flat blanks from the sheet, the blanks being of a shape, for example circular, such that not all of the sheet can be used. Metal, in common with other raw materials, is relatively expensive but its scrap value (if any) is much less. Scrap therefore represents a loss which is only partly recoverable, and even in the case of metals which are generally capable of being recycled for further use, the recyling process itself involves the employment of energy and therefore the use of fuel and possibly other natural resources.

The technology of pressing flat blanks from relatively thin metal sheet has advanced to a stage at which it is now possible to leave, between holes left in the sheet after pressing, webs of metal which at their thinnest point are only wafer thin. Nevertheless, in the case for example of blanks in the form of discs or rings, there must inevitably be a considerable amount of metal in each sheet that is wasted between the holes purely by virtue of the shape of the blanks.

Wastage also occurs at the edges of the sheet due to the fact that, whilst for certain non-rectangular shapes of blank, such as discs or rings, the most economical pattern to adopt is to blank the metal in rows which are usually staggered transversely, there will always occur at one end of each row an area of the sheet which is unusable and which, in the case of staggered rows in which alternate rows are identical, will be of a size approximately one-half of that required for making a row of blanks. Since sheet metal from which stampings, pressings or drawn articles are made (especially where such articles are relatively small and of simple shape) is mostly supplied in coils and edges of the coils are approximately straight, this wastage at the end of each row is usually accepted.

However, in many applications, especially those in which the sheet material has to undergo some preliminary operation or operations before being subjected to the stamping operation, it is not convenient to form the stampings from a long strip or web of the sheet material drawn direct from the coil; in such cases the strip or web must be cut into individual sheets for the preliminary operation or operations. As indicated above, it is in connection with such individual sheets that the present invention is conceived. Examples of such preliminary operations include treatment to remove irregularities at the edges or surface irregularities; plating; lacquering; and printing. For example, tin plate sheet for use in making components for food or beverage cans is for many applications pre-lacquered or printed or both.

Cutting individual rectangular sheets from the continuous strip drawn from the coils does however result in there being in each sheet, not only two side edges giving rise to wastage as described above, but also a front and a rear edge each of which causes wastage between the blanks. It has been a common practice, in order to overcome this disadvantage, to cut the individual sheets along a zigzag line such as to bisect the material lying between the sites of two adjacent transversely-staggered rows of blanks on the strip or web. In this way a castellated edge, usually referred to as a scrolled edge, is formed. This eliminates the wastage that would otherwise be caused by the formation of individual sheets.

Both because materials are becoming more precious and because they are becoming ever more expensive, thinner and thinner materials are being used for many products. This is especially true in the metal container industry, particularly in the case of so-called open-top cans, where relatively thin metal is now used for making can ends and can bodies.

In addition, modern container-making machinery, in common with other kinds of machinery used in the manufacture of pressed, stamped or drawn articles of which components for container are but one example, is in general capable of higher speeds than its predecessors. This applies also to machines such as printing machines which may print the sheet material before the articles or blanks of the appropriate shape are formed from it. Use of higher speeds and thinner sheet in general call for improved accuracy in manufacture. On the other hand thinner sheet is less susceptible to high accuracy, for example because of its greater flexibility and liability to undergo damage to the side edges, a common fault found in coils of tinplate as delivered to the user.

In conventional apparatus used for feeding sheet material to a stamping or drawing press (such as a blanking and cupping press) or to a printing machine, it is usual to employ the side edges of the sheet to guide it accurately in its predetermined orientation into the press. Side edge damage and lateral whip give rise to problems with this method, limiting both the accuracy of lateral or transverse location and also the speed at which the sheet can be conveyed. A further serious problem is that sheet material from different coils may not always be of the same width, since the tolerances on the nominal width which it is possible to obtain, particularly with thin sheet steel and other metals made in high speed rolling mills, are greater than is generally acceptable for high speed conveying of the sheet to a high speed precision machine such as a modern blanking and cupping press.

Various solutions to these problems have been proposed, and some successfully employed, such as the use of side lays which travel along with metal sheet and converge gradually into engagement with the side edges to guide it accurately into a high-speed printer.

DISCUSSION OF THE INVENTION

According to the invention, in a first aspect thereof, sheet feeding apparatus comprises fixed support means for supporting a sheet of the kind hereinbefore specified in its own plane along a predetermined path, and sheet-advancing means having a laterally-restrained main pusher element movable along said path, said main pusher element having a profile adapted to engage rearwardly in a recess of the said end edge, and in particular a said abrupt discontinuity of said edge, whereby to prevent lateral movement of the sheet, sheet-advancing means having steadying means, movable along said path and arranged to engage the same edge of the sheet so that, by virtue only of engagement of the steadying means with the rear edge of the sheet, the sheet is prevented from slewing away at an angle with the path in said plane. Top restraint means overlying the path of the sheet, engage the top surface of the sheet to hold it down in its plane.

In this way complete orientation of the sheet in its path is obtained without the need for any side lays or other edge guide means, whether fixed, adjustable or otherwise movable. Slight variations in sheet width are immaterial and, provided the profiled edge is accurately formed in the first place, the method allows the sheet to be accurately conveyed into register with a machine.

The sheet-advancing means preferably engages a rear or trailing edge of the sheet; the edge engaged by the sheet-advancing means is preferably a scrolled edge. We have found that in practice scrolled edges on thin tinplate sheet can be made under production conditions to an accuracy of ±0.007 inch. Accordingly, the said main pusher element preferably has a forward-facing sheet edge engaging surface joined at an end thereof to a side surface of the element extending rearwardly therefrom and inclined transversely outwardly with respect thereto.

The steadying means preferably comprise an auxiliary pusher element movable with the main pusher element but spaced therefrom in a direction having a component transverse to said path, the auxiliary pusher element being adapted so to engage a portion of the rear edge of the sheet as to restrain rearward movement of said edge portion with respect to the auxiliary element without preventing limited lateral movement of the sheet with respect thereto, whereby the sheet is located transversely by the main pusher element only. Conveniently, the steadying means consist of said main and auxiliary pusher elements in co-operation with each other.

According to a preferred feature of the invention, the sheet advancing means have a series of said main pusher elements spaced longitudinally of said path by a predetermined distance.

Preferably in such an arrangement, a plurality of said main pusher elements are mounted on a carrier member reciprocable back and forth by an amount corresponding to said predetermined distance, whereby to index said sheet forward by intermittent steps, each main pusher element being adapted to allow the sheet to lie flat until the rear edge of the sheet has been moved forward into engagement with the said element. In addition, the main and auxiliary pusher elements are preferably spaced longitudinally of said path by a predetermined spacing. In preferrred embodiments the sheet-advancing means have a series of said auxiliary pusher elements spaced longitudinally of said path by the same predetermined spacing as the corresponding main pusher elements, so that there is one auxiliary pusher element for co-operation with each main pusher element.

Thus, each of a series of main pusher elements is matched by a corresonding auxiliary pusher element. In preferred embodiments, such as that to be described hereinafter, the pusher elements are all mounted for movement together in a reciprocating mode such that on a forward stroke they feed a sheet forward by an amount equal to one pitch length defined between adjacent transverse rows of portions of the sheet to be successively operated on by the machine being fed. On the next stroke, which is a backward stroke, the elements do not move the sheet, and they are, in such an embodiment, therefore arranged accordingly, for example by being resiliently mounted. Upon completion of the backward stroke, the rear edge of the sheet is engaged by the elements next in front of those which moved it forward on the previous stroke.

The sheet feeding apparatus according to the invention is, in operation, arranged in combination with apparatus for performing a manufacturing operation on the sheet of material, the sheet feeding apparatus being juxtaposed with or incorporated in the other apparatus so as to feed a succession of said sheets intermittently to and/or through the latter. The said other apparatus is typically, though not necessarily, a press for making a series of blanks or cup-shaped articles from a sheet of material, whereby the sheet feeder conveys the sheet to the press, and the press presses at least one blank from the sheet (and, if required, forms the blank into a cup-shaped article) whilst the sheet is stationary between each intermittent advancing step of the sheet feeder and the next. The invention is particularly suitable for feeding thin sheets of metal, such as lacquered tinplate, having scrolled edges, to a high-speed blanking and cupping press which forms simultaneously from the sheet a plurality of circular blanks in one or more transverse rows and draws them into cups for subsequent re-drawing and/or wall ironing operations to form one-piece bodies for two-piece metal cans.

It will be understood furthermore that the invention is well adapted for use in systems where accurate conveying or feeding, at high speed, of a succession of sheets of material of the kind hereinbefore specified, is required to a machine for performing repetitive operations on the sheets, and further furthermore that the invention utilises to advantage the feature of a recessed profiled sheet edge which itself contributes towards the saving of material by reducing wastage.

A preferred embodiment of the invention in its various aspects will now be described, by way of example only, with reference to the accompanying drawings.

DESCRIPTION OF PREFERRED EMBODIMENT

Figure 1:
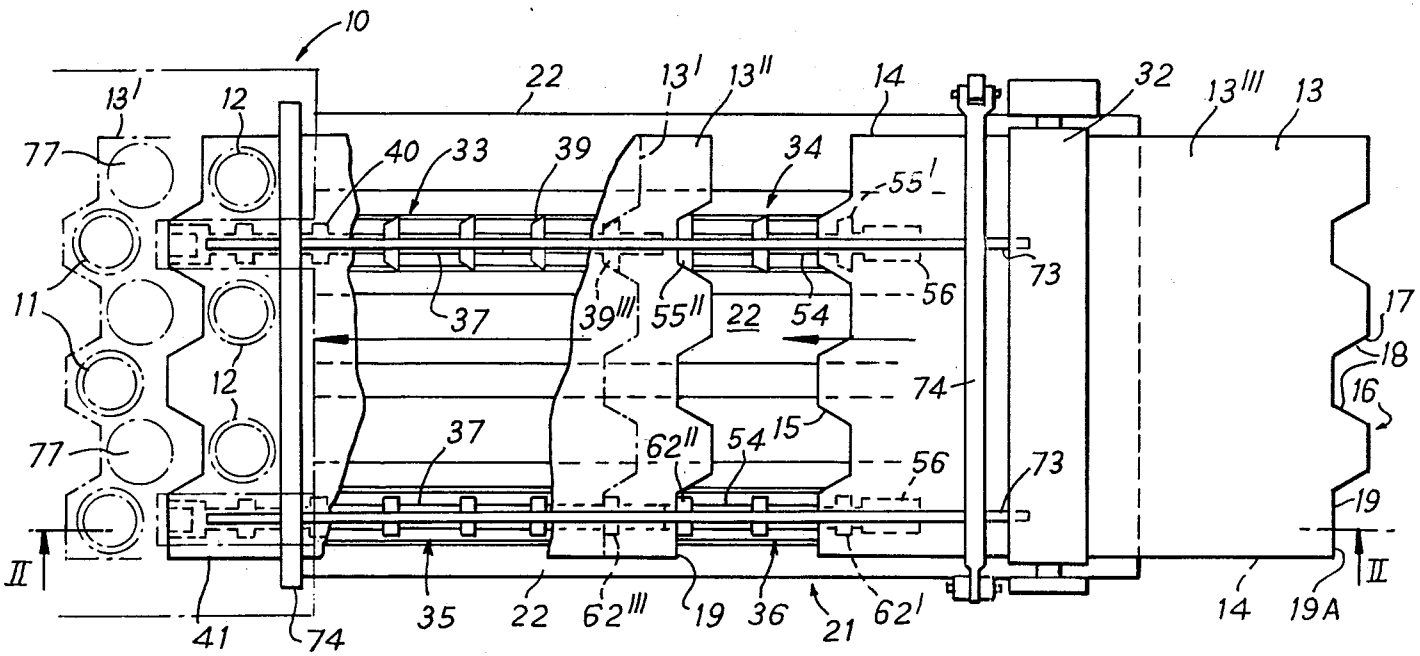
FIG. 1 is a simplified plan view showing a conveying apparatus in one preferred form according to the invention, being a sheet feeder arranged to feed scrolled metal sheets to and through a blanking and cupping press.
Figure 2:
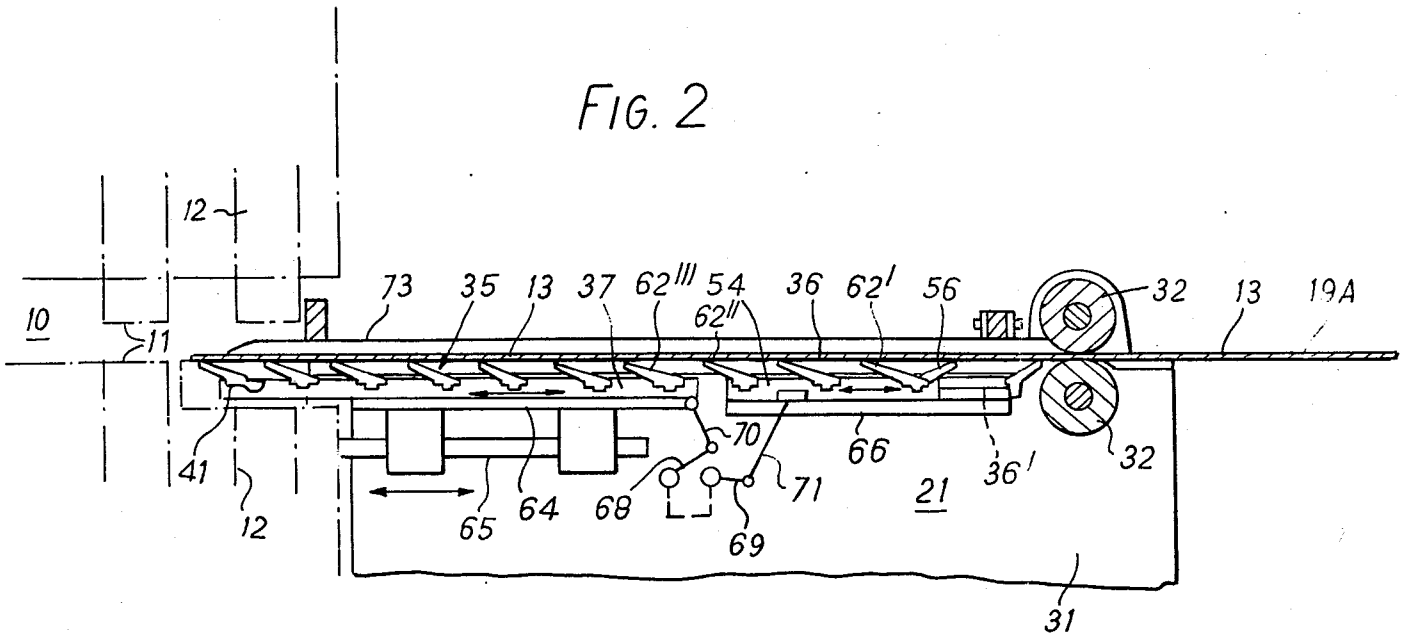
FIG. 2 is a simplified sectional elevation partly in diagrammatic form, taken on the line II—II in FIG. 1.

Referring to FIGS. 1 and 2, a blanking and cupping press is indicated diagrammatically at 10. The press 10 has two rows of tools 11, 12 respectively for forming disc-like blanks from sheets of tinplate 13 and for drawing the blanks into the form of cups for subsequent redrawing to form one-piece can bodies for two-piece cans.

Each sheet 13 has two side edges 14, a scrolled leading edge 15 and a scrolled trailing edge 16. The scroll profile of each trailing edge 16 includes recesses 17 each having two abrupt discontinuities or corners 18, each at the junction of a transverse edge portion and an inclined edge portion, the angle between these edge portions being 45°. The recesses 17 and a further recess 19 are all intermediate between the ends of the profiled edge 16, the recess 19 terminating at one side edge 14.

The sheets 13 are conveyed by the sheet feeder, generally indicated at 21, in succession, in longitudinally-spaced relationship, and in predetermined orientation, to the press 10 along a straight path, in the plane of the sheets, the direction of motion being indicated by the horizontal arrows in FIG. 1.

The sheet feeder 21 has a fixed main frame, part of which is indicated diagrammatically at 31, FIG. 2, with fixed longitudinal support bars 22 along the top thereof. At the rear end of the frame 31 a pair of lubricating rollers 32 are mounted to receive sheets 13 between them. In front of the lubricating rollers 32, the sheet feeder has a pair of feed units constituting the sheet-advancing means of the feeder. One of these feed units is a main feed unit and comprises a front main feed bar assembly 33 and a rear main feed bar assembly 34. The other feed unit is an auxiliary feed unit and comprises a front auxiliary feed bar assembly 35 and a rear auxiliary feed bar assembly 36. The main feed bar assemblies 33 and 34 are aligned longitudinally with each other, and the auxiliary feed bar assemblies 35 and 36 are aligned longitudinally with each other and spaced transversely apart. Movement of the main feed bar assemblies is arranged to occur simultaneously with that of the auxiliary feed bar assemblies, and through exactly the same distance.

The main and auxiliary feed bar assemblies are aligned with the press 10 in a manner to be described.

Figures 3, 4, 5, 6, 7:
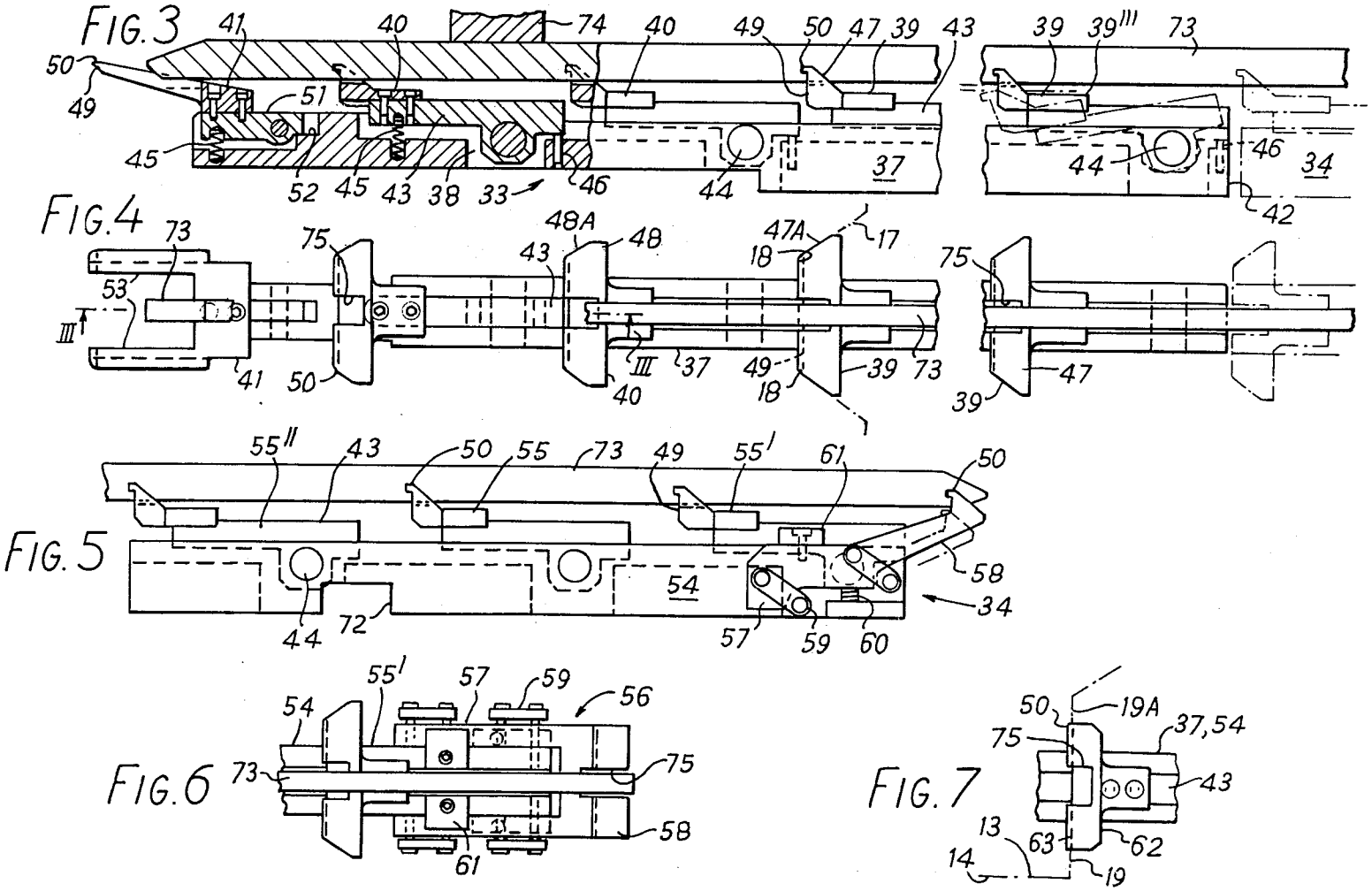
FIG. 3 is an elevation, shown in part-section on the line III—III in FIG. 4, of a front main feed bar assembly of the sheet feeder.
FIG. 4 is a plan view of a front main feed bar assembly of the sheet feeder.
FIG. 5 is an elevation of a rear main feed bar assembly of the same sheet feeder.
FIG. 6 is a plan view of the rear end of the assembly shown in FIG. 5.
FIG. 7 is a scrap plan view showing a feed dog of an auxiliary feed bar assembly of the same sheet feeder.

Referring now to FIGS. 3 and 4, the front main feed bar assembly comprises a first carrier member comprising a rigid feed bar 37, having a series of recesses 38 in which are accommodated first main pusher dogs 39, 40, 41. In this example (FIGS. 1 and 2) there are four identical dogs 39 spaced equally along the feed bar 37 from the rear end 42 of the latter, and two identical dogs 40 are arranged at the same spacing in front of the dogs 39. Each of the dogs 39, 40 comprises an arm 43 pivoted near its rear end by a transverse pin 44 in the feed bar 37 and biassed upwardly by a compression spring 45 against a stop 46. The front end of each arm 43 carries a nose piece 47 or 48 having a transverse flat front face 49 terminating in a top lip 50. The nose pieces 47 and 48 are so shaped, as is seen in FIG. 4, as to fit snugly in a recess 17 of the scrolled rear edge of a sheet 13, being located transversely very accurately with respect thereto by engagement with the corners 18 of the recess described above with reference to FIG. 1. More particularly, the forward-facing, sheet-engaging front face 49 is joined at each of its ends to a side surface 47A or 48A extending rearwardly from and inclined at 45° transversely outwards from, the face 49. The only difference between the dogs 39 and 40 is that the nose pieces 48 of the latter are slightly narrower than the nose pieces 47 of the dogs 39, this being an optional difference necessitated only by the fact that the dogs 40 extend so as to lie adjacent to the press 10 between two of the tools 12 thereof. In other applications it may be possible for all the dogs to be of the same width.

In front of the two dogs 40 is a leading dog 41 which comprises an arm 51 pivoted transversely in the feed bar 37 and biassed upwardly by a spring 45 against a stop shoulder 52. The arm 51 carries a bifurcated or forked nose piece 53. This shape of the nose piece enables the dog 41 to approach a press tool 12 very closely, whilst still engaging the rear edge of a sheet 13, so that a blank can be punched from the sheet closely adjacent to that edge.

It will be realised that any or all of the dogs in the main feed bar assemblies may have nose pieces of any shape such as to engage in a recess of the scrolled edge 16 and be located by the corners 18 thereof. Three examples of the actual preferred shape are shown in FIG. 4 for the dogs 39, 40 and 41; the shape of each dog is chosen to suit the particular application for which the conveying apparatus is intended.

Referring now to FIGS. 5 and 6, the rear main feed bar assembly 34 comprises a second carrier member comprising a rear feed bar 54 having three second main pusher dogs 55 mounted thereon under lateral restraint in the same manner as the dogs 39 are mounted on the front feed bar 37. The dogs 55 are furthermore identical with the dogs 39, but in this example they are spaced farther apart than the latter. At the rear end of the feed bar assembly 34 is a backwardly-directed dog 56 comprising a pair of parallel side plate portions 57 joined by an integral nose portion 58. The dog 56 is mounted on the feed bar 54 by means of two pairs (one pair each side of the feed bar) of parallel links 59, each pivoted at one end to the plate portion 57 at the same side of the feed bar, and pivoted at the other end to the feed bar 54 itself. The dog 56 is biassed upwardly by compression springs 60 against stops 61 fixed to the top of the feed bar 54.

The front and rear auxiliary feed bar assemblies 35, 36 are substantially identical with the front and rear main feed bar assemblies 33 and 34 respectively, the only difference being that for each of the dogs 39 and 40 of the front main assembly and each of the dogs 55 of the rear main assembly there is substituted in the auxiliary assemblies an auxiliary pusher element comprising a dog 62 having the nose shape shown in FIG. 7. This dog 62 has a front or sheet-engaging face 63 surmounted by a lip 50, but the length of the front face 63 is less than that of the transverse edge portion 19A of the end recess 19 of the scrolled edge 16 of the sheet 13. The front auxiliary feed bar 35 has a third carrier member in the form of a front feed bar 37 identical with the other bar 37, whilst the rear auxiliary feed bar assembly 36 has a fourth carrier member in the form of a rear feed bar 54 identical with the other bar 54. The feed bar 37 of the assembly 35 carries first auxiliary pusher dogs 41, 62, whilst the feed bar 54 of the assembly 36 carries second auxiliary pusher dogs 62, 56, the dogs 41, 56 being the same as the dogs 41, 56 of the main assemblies 33, 34. The auxiliary dogs engage in the sheet end recess 19, slidably against the edge portion 19A.

Each of the front feed bars 37 is fixed to a feed bar carrier 64 which is movable longitudinally on an accurately located fixed cicular bar 65 extending from the frame of the press 10. The bars 65 are adjustable as to their transverse position, so that the alignment of the front feed bar assemblies 33, 35 can be set accurately with respect to the press tools 11 and 12.

Each of the rear feed bars 54 is movable longitudinally in a guide 66 fixed to the frame 31. The feed bar carriers 64 and guides 66 are indicated diagrammatically in FIGS. 1 and 2.

The front feed bars 37 are movable simultaneously with each other forwards and backwards in a reciprocating mode through a distance substantially equal to the pitch between longitudinally-adjacent dogs of the front feed bar assemblies 33, 35. Similarly the rear feed bars 54 are movable simultaneously with each other, forwards and backwards in a reciprocating mode through a distance substantially equal to the pitch between longitudinally-adjacent dogs of the rear feed bar assemblies 34, 36. The reciprocating movement of the feed bars is effected by any suitable drive mechanism. To obtain the highest possible accuracy such drive mechanism is arranged to have the minimum of backlash and to give the smallest practicable acceleration and deceleration to the feed bars consistent with reciprocating movement of the latter at the speeds required. Minimal deceleration is particularly desirable during movement in the forward direction when dogs are maintained by friction in contact with the rear scrolled edge 16 of a sheet 13.

The drive mechanism operates the feed bars by any suitable reciprocating drive. Such drive may be driven from a suitable take-off shaft of the press 10, powered by the drive motor of the press itself. FIG. 2, for example, shows diagrammatically a pair of cranks 68, 69 rotatable to reciprocate the main feed bar assemblies and the auxiliary feed bar assemblies respectively through connecting rods 70, 71. Rods 71 engage in slots 72 (shown in FIG. 5) in the rear feed bars. Suitable coupling is arranged in known manner to give the desired timed relationship between the movements of the sheet feeder 21 and press tools 11 and 12.

Extending above and parallel to the main feed bars 37, 54 is a top feed guide element in the form of a bar 73. A similar bar 73 extends above and parallel to the auxiliary feed bars 37, 54. The bars 73 constitute a top feed guide and are fixed to a pair of cross-beams 74 carried by the feeder frame 31; the bars extend along substantially the whole path of the sheets 13 when the latter are under the control of the feed bar assemblies 33 to 36. The top feed guide is arranged to engage the upper surface of each sheet 13 in such a manner that the dogs below the sheet are depressed against their springs 45 or 60 with an upper surface of the nose of the dog in sliding contact with the underside of the sheet. This situation is indicated diagrammatically in respect of the rearmost dog 39 of the front feed bar assembly in FIG. 3, the depressed position of this dog being shown by chain-dotted lines. This particular dog is identified by the reference numeral 39''' in FIG. 3.

It will also be understood that the feed bar assemblies can be arranged in known manner for adjustable transverse spacing between the main feed bar assemblies on the one hand and the auxiliary feed bar assemblies on the other, to suit different edge profiles of the sheets to be engaged by the feed bar dogs.

In operation, the sheets 13 of tinplate, which may be lacquered, are introduced to the sheet feeder 21 one by one in timed relationship, by any suitable means such as a timed conveyor (not shown), adapted to give the sheets their correct orientation and lateral position; whereupon control of the sheet 13 is taken over by frictional contact between the sheet and the lubricating rollers 32, which feed the sheet on to the sheet feeder 21. The sheet slides under the top guide bars 73 and depresses the dogs below it in the manner described earlier herein with reference to FIG. 3.

When the scrolled trailing edge 16 of the sheet 13 leaves the lubricating rollers 32, it passes, by virture of its own momentum, over the rearmost dogs 56 of the rear feed bar assemblies. The latter are at this stage in their backward position as indicated in 36' in FIG. 2 for the rear auxiliary feed bar assembly 36. The sheet feeder 21 is arranged (for example by suitable spacing between the lubricating rollers 32) so that the sheet 13 will stop when its rear edge 16 is just past the lips 50 of the rearmost or first dogs 56, so that the latter are urged upwards from the position shown in phantom lines in FIG. 5 to that shown in full lines. This movement has in fact a backward component, by virtue of the parallel links 59, to ensure that the dogs 56 can rise fully without fouling the sheet 13.

The movement, positioning and orientation of the sheet in a horizontal plane are now entirely and solely under the control of the dogs of the feeder 21, and remain so until the last blanks have been formed by the press tools 11 and 12, as will be seen.

The feed bars 37, 54 are now moved forward to the forward position (in which they are shown in full lines in FIGS. 1 and 2). The sheet 13 is thus pushed forward by the dogs 56 by one pitch of the rear feed bar dogs. The feed bars 37 and 54 are moved back to their rearward position, so that the rear edge of the sheet is now engaged by the second pair of dogs indicated at 55' and 62' in FIG. 1. This process is repeated, the sheet being handed from one pair of dogs to the next, and advanced by one pitch at a time intermittently. As each main dog and its corresponding auxiliary dog engage the respective recesses 17 and 19 in the rear end of the sheet, they co-operate to prevent the sheet slewing away at an angle with the path of the sheet in the plane of the sheet, thus constituting a steadying means for the sheet, and correcting any errors in orientation of the latter. In addition, each main dog (56, 55, 39, 40, 41), in engaging the sheet 13 in its turn, corrects any slight errors in lateral position of the sheet that may occur during the previous forward movement of the latter.

Thus by virtue only of the steadying action of the pusher dogs, the sheet is maintained in its correct alignment without the need for any guides engaging the sides of the sheet.

When the sheet 13 is engaged by the leading dogs 55'', 62'' of the rear feed bar assemblies 34 and 36 respectively, it is in the position indicated at 13'' in FIG. 1, in which position the first row of blanks is formed from the sheet by the press tools 12. The next reciprocating movement of the feed bars 37 and 54 transfers control of the sheet from the rear feed bar dogs to the front feed bar dogs, which control it during all subsequent operations of the press 10 on that sheet.

It will be observed from FIG. 1 that in this example the pitch of the sheet feeder dogs, from the leading dogs 55'' and 62'' of the rear feed bars forward, is so related to the pitch between the transverse rows of press tools 11 and 12 respectively that, when a sheet is transferred from the position 13'' to the position indicated at 13', i.e. from the leading dogs 55'', 62'' of the rear feed bars 54 to the rearmost dogs 39''', 62''' of the front feed bars 37, the second row of blanks can be formed by the press tools 11 adjacent to the first row, the site of which in the position 13' is indicated at 77 in FIG. 1. For the forming of the final row of blanks, immediately adjacent to the scrolled edge 16, the bifurcated foremost dogs 41 engage the sheet, whereafter the remains of the sheet are removed forwards by suitable means (not shown).

It will be understood that various modications are possible to the conveying apparatus described. For example, each main dog and its associated auxiliary dog may be combined in a single transverse member incorporating both the main and the auxiliary pusher elements. With such an arrangement there may be a single carriage taking the place of the two front feed bars, and a single carriage taking the place of the two rear feed bars, thus somewhat simplifying the sheet feeder.

Whether or not the main pusher elements are separate members from the auxiliary pusher elements, the pusher elements need not be in the form of dogs pivoted in a longitudinal vertical plane. They could, for example, be pivoted in a transverse vertical plane or not pivoted at all to the feed bars but mounted thereon by means of springs for "floating" movement up and down. In place of any one or more of the main dogs there could be provided a set of upstanding pins, spring-loaded for vertical movement with respect to the feed bar and comprising two pins each arranged to engage a corner 18 of the scroll edge recesses 17, and a further pin for engaging one of the inclined edges of one of the recesses 17 to co-operate with the auxiliary pusher element in preventing slewing of the sheet. Similarly a single such pin may be substituted for one or more of the auxiliary dogs, since essentially only single-point contact is needed to fulfil the function of the latter.

Again, the lateral locating function of each of the main dogs in the embodiment described herein may be performed by a pair of pusher elements spaced apart transversely and engaging in two different recesses 17. For example, one such element could be arranged to engage the right-hand corner 18 only of the upper recess 17 (as viewed from the rear of the sheet) and the other element the left-hand corner only of the lower recess 17. Such pusher elements could each be generally similar to the main pusher elements shown in the Figures, but having a slightly shorter front face 49 not reaching as far as the corner 18 not engaged, and having only one inclined face such as 47A, 48A. Alternatively each such element might be a single spring-loaded pin of the kind suggested above.

Such arrangements can be advantageous, for example, where the sheet to be conveyed is very wide or very thin.

We claim:

1. Sheet feeding apparatus comprising fixed support means defining a sheet path for supporting in its own plane along said path a sheet of material having an end edge with a recessed profile defined by at least one abrupt discontinuity intermediate between the ends of the end edge; sheet-advancing means adjacent said support means and having a main pusher element; means for moving said sheet-advancing means along said path, said main pusher element having a profile adapted to engage in a recess of the sheet edge; means restraining said main pusher element laterally whereby to prevent lateral movement of the sheet; and top restraint means overlying said path for engaging the top surface of the sheet to restrict movement thereof to movement in said plane, said sheet-advancing means having steadying means for engaging the sheet end edge so that, by virtue only of said steadying means engaging the sheet end edge, the sheet is prevented from slewing away at an angle with said path in said plane, said steadying means comprising an auxiliary pusher element spaced from said main pusher element in a direction having a component transverse to said path, said auxiliary pusher element having a transverse sheet-engaging face but being free of any non-transverse sheet engaging face, whereby the sheet is located transversely of said path by said main pusher element only, said sheet-advancing means further comprising means for moving said main and auxiliary pusher elements simultaneously and in parallel paths.

2. Apparatus according to claim 1, comprising means laterally restraining said auxiliary pusher element.

3. Apparatus according to claim 1, wherein said steadying means consist of said main and auxiliary pusher elements in co-operation with each other.

4. Apparatus according to claim 1, comprising common drive means for said main and auxiliary pusher elements, and means operatively connecting them with said common drive means for moving said elements simultaneously by equal amounts in said path.

5. Apparatus according to claim 4, wherein the sheet-advancing means comprise a series of said main pusher elements; first mounting means mounting said main pusher elements in positions spaced along said path; a series of said auxiliary pusher elements; and second mounting means mounting said auxiliary pusher elements in positions spaced along said path by the same spacing as said main pusher elements, so that each said auxiliary pusher element is available for co-operation with a corresponding one of said main pusher elements.

6. Apparatus according to claim 5, wherein said second mounting means comprises an auxiliary carrier member, of said auxiliary pusher elements being mounted on said auxiliary carrier member, said apparatus further comprising reciprocable drive means for reciprocating said auxiliary carrier member back and forth by an amount corresponding to said spacing, each auxiliary pusher element comprising retracting means for retracting said element out of said path to allow said sheet to lie flat thereon, and for engaging said element with said sheet edge when the corresponding main pusher element is also in engagement therewith.

7. Apparatus according to claim 6, wherein said main pusher elements comprise a series of first main pusher elements carried by a first main carrier member, and a series of second main pusher elements aligned behind said first main elements and carried by a second main carrier member, said auxiliary pusher elements comprising a series of first auxiliary pusher elements carried by a first said carrier member, and a series of second auxiliary elements aligned behind the first auxiliary elements and carried by a second said auxiliary carrier member said apparatus comprising first and second said reciprocable drive means, said first drive means being coupled to said first carrier members for reciprocating them both simultaneously by an amount corresponding to the spacing between each said first pusher member and the next, said second drive means being coupled to said second carrier members for reciprocating them both simultaneously by an amount corresponding to the spacing between each said second pusher element and the next, and means coupling said first and second drive means together in a predetermined timed relationship, whereby to index said sheet forward by intermittent steps, each main pusher element comprising retracting means for retracting said element out of said path to allow said sheet to lie flat thereon until said sheet edge is moved forward into engagement with said element.

* * * * *